US006149495A

United States Patent [19]

Austin et al.

[11] Patent Number: 6,149,495

[45] Date of Patent: Nov. 21, 2000

[54] CONFETTI AND THEATRICAL SNOW DELIVERY DEVICE

[76] Inventors: Joseph James Austin, 4642 Willis Ave. Apartment 310, Sherman Oaks, Calif. 91403; Joseph Stanley Austin, 5837 Belbert Cir., Calabasas, Calif. 91302

[21] Appl. No.: 09/267,614

[22] Filed: Mar. 15, 1999

[51] Int. Cl.[7] ..... A63H 37/00; A63G 31/00; A01D 87/10; B65G 69/06; B05B 7/14

[52] U.S. Cl. ..... 446/475; 472/65; 222/637; 222/195; 406/102

[58] Field of Search ..... 446/475, 483, 446/481, 487, 491, 71, 75; 472/51, 52, 65; 222/637, 195; 401/98, 102, 133

[56] References Cited

U.S. PATENT DOCUMENTS

| | | | |
|---|---|---|---|
| 825,843 | 7/1906 | Kliemandt . | |
| 1,153,207 | 9/1915 | Eisenberg . | |
| 1,441,809 | 1/1923 | Johnston . | |
| 1,560,326 | 11/1925 | Rutherford . | |
| 1,663,679 | 3/1928 | Carpenter . | |
| 1,664,401 | 4/1928 | Craig . | |
| 2,756,737 | 7/1956 | Resch, Jr. . | |
| 2,786,720 | 3/1957 | Kuttner et al. | 222/637 |
| 2,870,565 | 1/1959 | Martin | 222/637 |
| 3,018,968 | 1/1962 | Levey . | |
| 3,659,751 | 5/1972 | Jackson et al. . | |
| 4,231,665 | 11/1980 | Shelton . | |
| 4,236,654 | 12/1980 | Mello . | |
| 4,792,093 | 12/1988 | Suga et al. . | |
| 5,015,211 | 5/1991 | Reveen . | |
| 5,033,649 | 7/1991 | Copeland et al. . | |
| 5,332,133 | 7/1994 | Murata et al. . | |
| 5,351,890 | 10/1994 | Clements | 222/637 |
| 5,381,779 | 1/1995 | Shelton . | |
| 5,403,225 | 4/1995 | Watkins . | |
| 5,429,278 | 7/1995 | Sansalone | 222/195 |
| 5,671,869 | 9/1997 | Althouse et al. . | |
| 5,713,494 | 2/1998 | Kaiju et al. . | |

OTHER PUBLICATIONS

"Confetti Volcano", Aerotechnics, Special F/X, Inc., Mar. 1996.

*Primary Examiner*—D. Neal Muir
*Attorney, Agent, or Firm*—Evan M. Kent; Hoffman, Wasson & Gitler

[57] ABSTRACT

A device for propelling confetti or theatrical snow comprising two compartments. One compartment houses a vacuum device having an intake in communication with the other compartment and an exhaust in communication with the exterior of the device. The second compartment holds the confetti or theatrical snow. Only material which is able to be airborne is able to enter the vacuum device and be expelled through the vacuum device. Confetti can be reintroduced into the second compartment without fear of foreign objects mixed with the confetti becoming dangerous projectiles.

14 Claims, 3 Drawing Sheets

CONFETTI AND THEATRICAL SNOW DELIVERY DEVICE

FIELD OF THE INVENTION

The invention relates to devices for propelling confetti or theatrical snow through the air.

BACKGROUND OF THE INVENTION

The success of amusement park attractions, stage shows, concerts, night club events, or other special events, is often dependent in part upon the automated features of special effects. For example, devices used by night clubs, stage, theater or special effects professionals, are often automated devices, allowing the operator to continually operate the machine from a remote position. Such devices include fog machines, bubble making machines and mist machines.

Light, particulate matter, such as confetti or theatrical snow, is often used in stage productions or other special events. It is often desired to create a "storm" effect of confetti. Establishments such as Universal Studios use confetti dispensers for shows, such as their Totally Nickelodeon show. Disney World conducts a New Year's celebration at midnight, every night, at their Pleasure Island attraction. There are many other amusement parks that are using such confetti distributors to create a storm effect.

Conventional confetti dispensers are not able to reuse the confetti that has been through the machine.

It is an object of this invention to provide a confetti dispenser that is able to reuse confetti.

It is another object of the invention to have a confetti dispenser which is able to separate the confetti from any foreign objects that may be mixed with the confetti.

It is a further object of the invention to have a confetti dispenser that is portable, lightweight and able to be attached to any structure.

It is still another object of the invention to have a confetti dispenser having a remote confetti reservoir.

It is yet another object of the invention to have a confetti dispenser that can be reloaded while in use, either at the device itself, or at a remote confetti reservoir.

It is another object of the invention to self-feed confetti from the reservoir through the system giving the unit automated properties.

These and other objects will become apparent after consideration of the description of the invention which follows.

SUMMARY OF THE INVENTION

The device is self contained within a case having two compartments. One compartment houses a vacuum device able to create a vacuum to intake confetti, or other light, particulate matter and expel it through an exhaust at high speeds. The expelled particulate matter is airborne and flies through the air to create the "storm" effect. The second chamber holds the light, particulate matter itself. The intake to the vacuum is in the divider wall between the two compartments. The intake is mounted high on the divider wall and when the vacuum is in operation, a vacuum is created in the light, particulate matter storage compartment. Since the intake is mounted above the floor of the case, only matter which is light enough to become airborne is introduced into the vacuum.

While the machine is operating, confetti can be introduced into the storage chamber. The operator of the device does not have to fear that foreign matter mixed in with the confetti will become a dangerous projectile by being launched by the vacuum device. The confetti can be input directly through an intake port in the storage chamber or can be stored in a reservoir connected to the storage chamber by a hose.

DETAILED DESCRIPTION OF THE INVENTION

Figure 1:
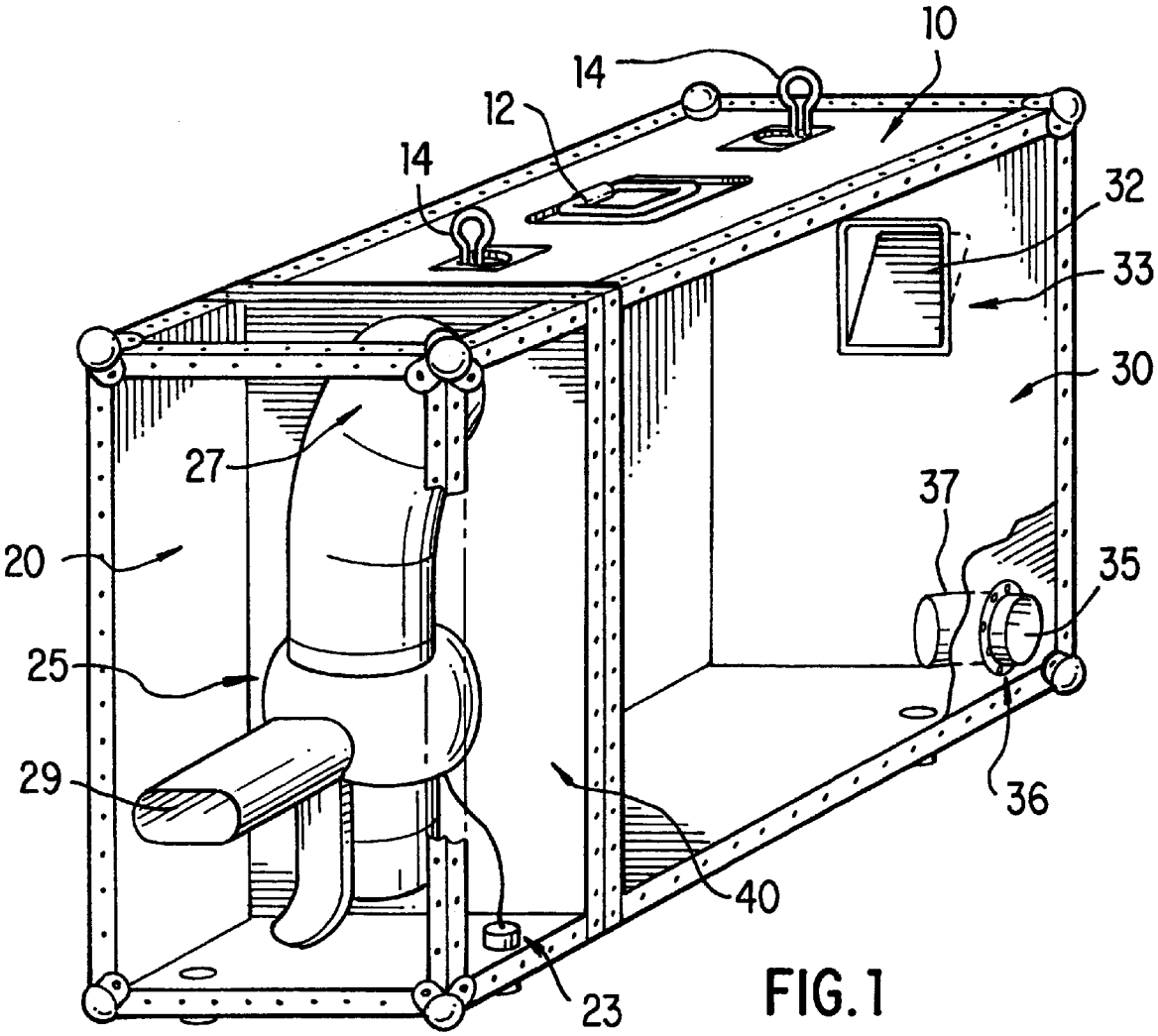
FIG. 1 is a perspective view of the device with certain panels removed to show details of the interior.

FIG. 1 shows the device with certain of the case panels removed so that the details of the interior can be seen. The device has an outer case 10 that is divided between a vacuum chamber 20 and a storage chamber 30. The outer case is provided with a carrying handle 12. Also, truss rings 14 as connected to the outer case. The truss rings allow the device to be attached to another structure.

The two chambers are divided by a divider wall 40. Housed within the vacuum chamber is a vacuum device 25. The vacuum device has an intake 27 which extends through the divider wall 40. As can be seen in figures, the intake is located above the mid-point of the divider wall 40. The vacuum device also has an exhaust 29 which extends through the side wall of the outer case 10. Material entering the intake device flows through the vacuum device and exits through the exhaust nozzle 29. The vacuum device is wired to an electrical outlet 23 which is retained in a side wall of the outer case 10.

Figure 3:
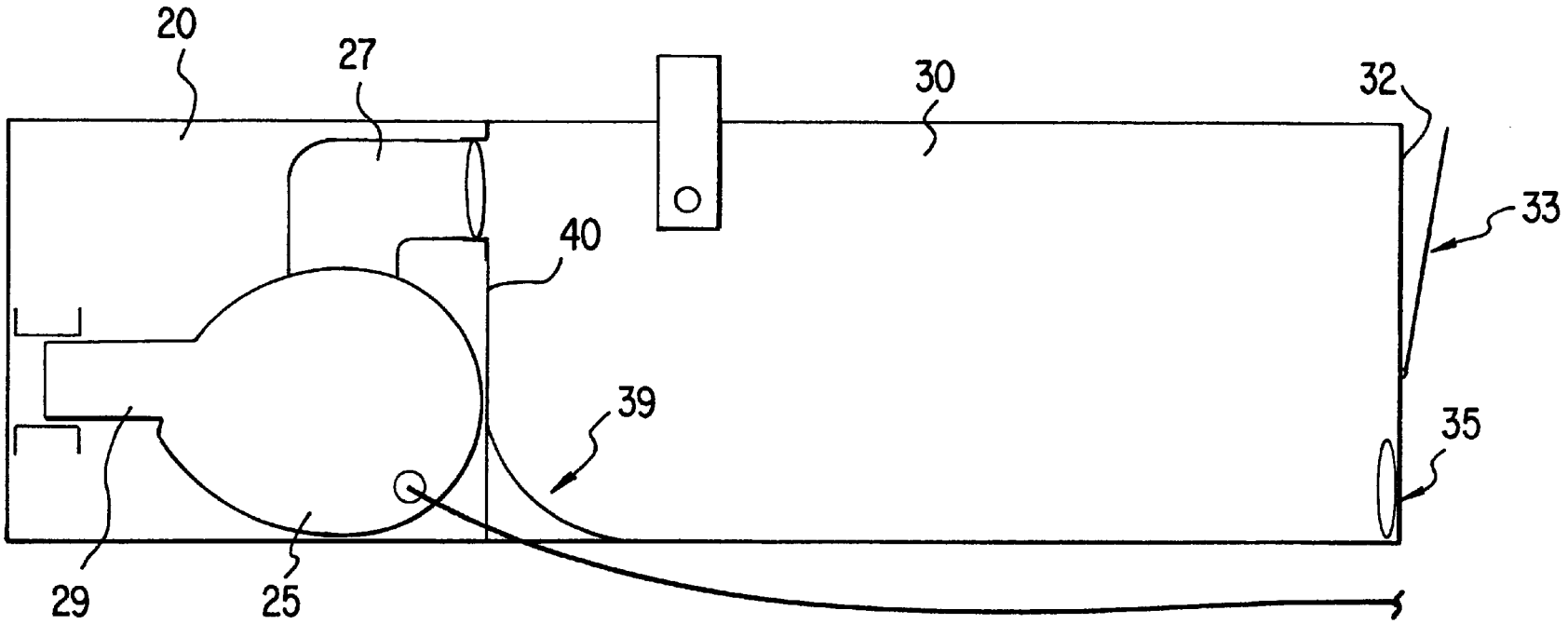
FIG. 3 shows a schematic view of the device.

The other compartment of the case is the storage compartment 30. One of the side walls is provided with an access port 32 which is selectively closed by an access panel 33. The chamber also has an intake port 35. On the exterior side of the intake port is a hose ring 36 for the selective connection of a hose. On the interior of the intake port is a one-way valve 37. In the invention, the one-way valve is in the form of a fabric, cylindrical tube. When air is being drawn the intake port, the force of the air is sufficient to open the tube to its full cylindrical circumference. When no air is being drawn through the intake, as when the vacuum device is off, the tube collapses upon itself and prevents the escape of any confetti from the storage compartment. As can be seen in FIG. 3, a curve guide 39 can be used at the junction of the divider wall 40 and the bottom of the case. This curved wall helps to propagate a vortex within the storage compartment. This vortex helps to get the light, particulate matter airborne.

To use the machine, the access port 32 is opened and the storage chamber is initially filled with confetti. Afterwards, the access panel 33 is used to close the access port 32 so that during use light, particulate matter does not escape the device through this port. When the vacuum device 25 is turned on, a vacuum is created in the storage chamber 30 and air from the storage chamber enters the vacuum device, travels through the vacuum device, and exits through the exhaust nozzle. Any particulate matter in the air stream entering the vacuum device travels with the air through the device and exits the device along with the air stream. By the manner, the confetti is airborne and the "storm" effect is created.

As the vacuum is created in a storage chamber 30, and air is driven from the storage chamber into the vacuum device 25, any light, particulate matter in the storage chamber 30 becomes airborne and travels with the air through the vacuum device 25. Since the vacuum intake 27 is above the base of the device, only particles which can become airborne are introduced into the vacuum device 25. Any foreign objects mixed in with the confetti are unable to become airborne and remain in the storage chamber 30. In this way, no foreign objects can become dangerous projectiles by being forcibly ejected through the vacuum device 25.

When the vacuum is created within the storage chamber 30, air is introduced into the storage chamber through the intake port 35. While in use, the air flowing through the intake port opens up the one-way valve 37 on the interior of the intake port. The operator of the confetti dispenser can introduce confetti directly into the intake port 35 simply by moving confetti in the vicinity of the port. The confetti can either be drawn in by the intake of air or manually pushed-in by an operator. Another way of supplying continually supplying a confetti to the confetti dispenser is by use of a confetti reservoir.

Figure 2:
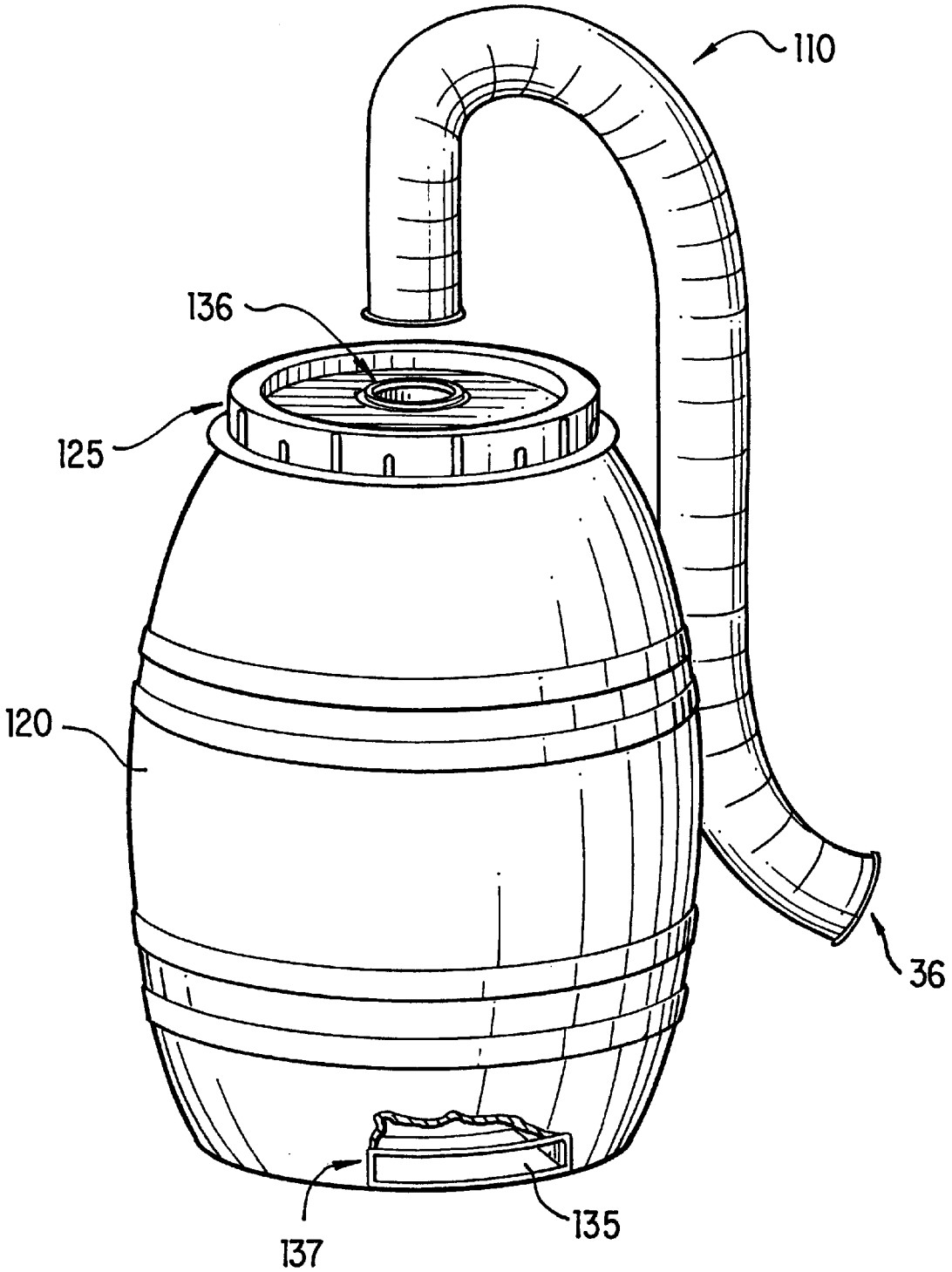
FIG. 2 shows the storage reservoir and the associated hose.

As seen in FIG. 2, the confetti reservoir 120 is connected to the confetti dispenser by a smooth bore hose 110. The smooth bore hose 110 is connected to the intake port at the hose ring 36. The reservoir 120 is provided with a removable lid 125. The removable lid has a similar hose ring 136. The other end of the smooth bore hose 110 is connected to this hose ring 136. The confetti reservoir preferably has a volume of 38 gallons, but any size of 5 through 55 gallons is envisioned. This reservoir is provided with an intake port 135. The interior of the intake port is provided with a one-way valve 137. Similar to the one-way valve in the storage chamber, the one-way valve is a fabric tube 37 having a cross-section that matches the cross-section of the intake port 135.

With the confetti reservoir attached via the hose 110 to the particulate matter dispenser, air travels through the intake port 135, through the reservoir, through the hose and ultimately into the storage chamber. Once in the storage chamber 30, the air travels as described earlier through the vacuum device 25. When connected, the vacuum reservoir 120 is a continual source of confetti. As the air travels through the reservoir 120 on its way ultimately through the particulate matter dispenser, it carries with it a stream of light, particulate matter. In this manner, the device can be used for long periods of time without the need for refilling it. Also, the reservoir 120 can be filled with used confetti. It acts as another safeguard against foreign objects becoming projectiles. This is because any foreign object would have to be light enough to be carried by an airstream through the reservoir, the hose and ultimately through the storage chamber to reach the vacuum device. This ensures that only particles as light as confetti will be introduced into the vacuum device.

While the structure and operation of the invention has been described with reference to a preferred embodiment, certain modifications and adaptations would be obvious to one of ordinary skill in the art. The description is not meant to limit the invention to the preferred embodiment, as such modifications and adaptations are within the spirit and scope of the invention.

We claim:

1. A particulate matter dispenser, comprising an outer casing, a vacuum chamber in the outer casing, a particulate matter storage compartment in the outer casing, a divider wall separating the vacuum chamber and the particulate matter storage compartment, a vacuum device housed in the vacuum chamber, the vacuum device having a vacuum intake in communication with the particulate matter storage compartments, an exhaust nozzle in communication with the exterior, said vacuum device located between said exhaust nozzle and said particulate matter storage compartment.

2. The dispenser of claim 1, further comprising an air intake port in the particulate matter storage compartment.

3. The dispenser of claim 2, further comprising a hose attachment bracket around the air intake port.

4. The dispenser of claim 2, further comprising a remote storage container, a hose connecting the remote storage container to the air intake port.

5. The dispenser of claim 1, further comprising a material access port, an access panel for closing the material access port.

6. The dispenser of claim 1, further comprising a curved guide in the particulate matter storage compartment for getting the particulate matter airborne when the compartment is under a vacuum.

7. The dispenser of claim 2, further comprising a one-way valve on the interior of the air intake port.

8. The dispenser of claim 7, wherein the one-way valve is a collapsible fabric tube.

9. The dispenser of claim 1, further comprising an electrical connector in the outer casing.

10. The dispenser of claim 9, wherein the vacuum device is wired to the electrical connector.

11. The dispenser of claim 1, further comprising metal rings on the outer casing for mounting the dispenser to a structure.

12. A particulate matter dispenser comprising:

an outer casing having a bottom, a top and at at leasts one side, a vacuum device housed within said outer casing, the vacuum device having an inlet and an exhaust, the vacuum device exhaust extending through said at least one side;

the vacuum device inlet located above the outer casing bottom so that it receives only particles that are airborne, and an intake port for introducing particulate matter into the outer casing, a flow path created between said intake port and said vacuum device exhaust, said flow path passing through said vacuum device.

13. The particulate matter dispenser of claim 12, further comprising a one-way valve on said intake port.

14. The particulate matter dispenser of claim 13, wherein said one-way valve is a fabric tube.

* * * * *